US007463130B2

(12) United States Patent
Oki

(10) Patent No.: US 7,463,130 B2
(45) Date of Patent: Dec. 9, 2008

(54) INDUCTANCE ELEMENT

(75) Inventor: Juichi Oki, Miyagi-Ken (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 11/613,860

(22) Filed: Dec. 20, 2006

(65) Prior Publication Data

US 2007/0146110 A1 Jun. 28, 2007

(30) Foreign Application Priority Data

Dec. 22, 2005 (JP) ..... 2005-369812
Oct. 11, 2006 (JP) ..... 2006-277828

(51) Int. Cl.
*H01F 27/29* (2006.01)

(52) U.S. Cl. ..... 336/192

(58) Field of Classification Search ..... 336/65, 336/83, 84 R, 84 M, 192, 200, 232
See application file for complete search history.

(56) References Cited

U.S. PATENT DOCUMENTS 5,680,087 A * 10/1997 Sakata et al. ..... 336/83
6,154,112 A * 11/2000 Aoba et al. ..... 336/192
6,566,993 B1 * 5/2003 Otsuka et al. ..... 336/83
2004/0189433 A1 * 9/2004 Ooki ..... 336/200

FOREIGN PATENT DOCUMENTS

JP 07201577 A * 8/1995
JP 2004303828 A * 10/2004
JP 2005045052 A * 2/2005

OTHER PUBLICATIONS

Patent Abstracts of Japan—Publication No. 2005-150470 published Jun. 9, 2005 Taiyo Yuden Co Ltd "Chip Inductor And Method For Manufacturing The Same" with an electronic translation generated by the Japanese Patent Office.
Patent Abstracts of Japan—Publication No. 2005-285901 published Oct. 13, 2005 Sumida Corporation "Electronic Component And Manufacturing Method Thereof" with an electronic translation generated by the Japanese Patent Office.

* cited by examiner

*Primary Examiner*—Tuyen T. Nguyen
(74) *Attorney, Agent, or Firm*—Stephen Chin; von Simson & Chin LLP

(57) ABSTRACT

An inductance element (10) according to the present invention includes: a drum core (20) provided with an upper flange portion (21), a lower flange portion (23), a columnar leg portion (22) and a wiring frame portion (25) surrounded by the upper flange portion (21), the lower flange portion (23) and the columnar leg portion (22); a coil (40) arranged at wiring frame portion (25) and formed by winding a wire (41); and a resin curing portion (50) formed by curing a mixed material mixing magnetic powders and resin and coating at least the wiring frame portion (25) and the coil (40). In addition, a plurality of terminal members (30*a*, 30*b*) as well as a bottom portion (31) and a plurality of peripheral wall portions (32) are included, in which a space portion (35) is formed between the peripheral wall portion (32) and the drum core (20), and the mixed material is filled into the space portion (35) to form the resin curing portion.

7 Claims, 5 Drawing Sheets

INDUCTANCE ELEMENT

CROSS-REFERENCE TO RELATED APPLICATIONS

This application claims priority of Japanese Application Nos. 2005-369812, filed Dec. 22, 2005 and 2006-277828, filed Oct. 11, 2006, the complete disclosures of which are hereby incorporated by reference.

BACKGROUND OF THE INVENTION

1. Field of the Invention

The present invention relates to an inductance element used in electric equipment such as a cellular phone, a digital camera, a mobile device, a laptop personal computer and the like.

2. Description of the Related Art

In recent years, inductance elements are demanded further downsizing and height reduction. In addition, the inductance elements are further demanded to have a resistance to shocks applied from outside when mounted onto a variety of electric equipment. Meanwhile, the inductance elements can be divided into various types. Out of the various types, Japanese Patent Application Laid-Open No. 2005-285901 (Patent document 1) (refer to abstract, FIG. 1, FIG. 2 and so on) discloses one type having a structure in which a wiring frame portion of a drum core has a coil, and a ring core is arranged around the coil, and further cup terminals are arranged around the outer peripheral sides of the ring core. On the other side, in Japanese Patent Application Laid-Open No. 2005-150470 (Patent document 2) (refer to paragraph #0017, FIG. 1 and so on), a structure, in which a coil is arranged at a T-shaped core and a resin layer coats the peripheral of these T-shaped core and the coil, is disclosed.

As described above, the inductance elements are demanded further downsizing and height reduction. In addition, the inductance elements are further demand the reduction in the number of parts, and the steps and costs in their manufacturing.

Here, in the structure disclosed in Patent document 1, a core of a ring shape (ring core) is arranged around a drum core. In addition to that, an adhesive is applied on the surfaces of the cup terminals and the drum core, and the cup terminals and the ring core are jointed via the adhesive. Therefore, the number of the parts increases due to the existence of the ring core, and the cost also increases thereby. Further, the number of steps increases so as to bond the ring core, which also increases the costs.

Furthermore, in Patent document 1, at the inner peripheral side of the cup terminals, the drum core and the ring core are arranged. Here, the cup terminal has a bottom portion and the outer peripheral side of the bottom portion is provided to follow an arc shape. Therefore, the outer diameter of the cup terminal comes to be larger than the drum core and the ring core, in which the inductance element is put into the state against the demand of downsizing.

Further, in the structure disclosed in Patent document 2, an exterior resin layer containing magnetic powders is provided to coat the wire. However, when forming the exterior resin layer, it is needed to be formed separately using a formwork or the like, requiring an additional fixture or the like. Therefore, the cost increases due to the required fixture. Further, when forming the coil, the wiring guide is required. Therefore, in comparison with the case where the wiring is wound directly around the winding frame portion, the cost increases due to the required wiring guide, in which working efficiency degrades as well. Moreover, after the coil and the exterior resin layer are formed, a work cutting them into two pieces is required as well.

SUMMARY OF THE INVENTION

The present invention has been made on the basis of the above-described circumstances, and an object thereof is to provide an inductance element capable of reducing the size, the height and the number of parts thereof as well as the number of steps in the manufacturing thereof In order to bring a solution to the above-described problems, an inductance element according to the present invention includes: a drum core provided with an upper flange portion, a lower flange portion and a columnar leg portion coupling the upper flange portion and the lower flange portion) together with a wiring frame portion surrounded by the upper flange portion, the lower flange portion and the columnar leg portion; a coil arranged at the wiring frame portion and formed by winding a wire; and a resin curing portion formed by curing a mixed material mixing magnetic powders and uncured resin and coating at least the wiring frame portion and the coil.

When it is structured in the above-described manner, at least, the winding frame portion and the coil are coated by the resin curing portion. Here, the resin curing portion contains the magnetic powders together with the resin serving as an adhesive. Therefore, the outer peripheral side of the coil and winding frame portion and the coil comes to a state coated by the magnetic powders. Accordingly, the resin curing portion can serve as an alternative of the current ring core. Backed by this, the ring core becomes unnecessary, in which the number of parts can be reduced and thereby the costs can be reduced.

Further, another invention includes: a drum core including an upper flange portion, a lower flange portion and a columnar leg portion coupling the upper flange portion and the lower flange portion together with a wiring frame portion surrounded by the upper flange portion, the lower flange portion and the columnar leg portion; a coil arranged at the wiring frame portion and formed by winding a wire; and a resin curing portion formed by curing a mixed material mixing magnetic powders and uncured resin and coating at least the wiring frame portion and the coil; and a plurality of terminal members each including a bottom portion formed to have a polygonal shape and a plurality of peripheral walls provided upright from any side of the bottom portion, the respective plurality of peripheral walls contacting partially with at least one outer peripheral edge of the upper flange portion and the lower flange portion, in which a space portion is formed between the peripheral wall portion and the drum core to form the resin curing portion by being filled with the mixed material thereinto.

When it is structured in the above-described manner, at least, the winding frame portion and the coil are coated by the resin curing portion. Here, the resin curing portion contains the magnetic powders together with the resin, therefore, the outer peripheral side of the winding frame portion comes to the state coated by the magnetic powders. Accordingly, the resin curing portion can serve as the alternative of the current ring core. Backed by this, the ring core becomes unnecessary, in which the number of parts can be reduced and thereby the costs can be reduced.

Further, the bottom face of the terminal member contacts at least one of the upper face and the lower face. Backed by this, the terminal member comes to the state where it is positioned with respect to the drum core. Furthermore, when such a positioning is performed, the space portion is formed between the drum core and the terminal member. The resin curing portion is then formed in the space portion.

Based on this, the positioning is performed by letting the terminal member contact the drum core, and the resin curing portion is arranged in the space portion formed as a result thereof, so that the inductance element can be formed. Further, the terminal members can serve as a container when arranging the resin curing portion, allowing preventing the uncured mixed material from leaking outside when forming the resin curing portion.

Moreover, still another invention includes, in addition to the above invention, a binging terminal to bind the end of the wire at any of the plurality of peripheral wall portions.

When it is structured as described above, the end of the wire is bound around the binding terminal. After the end is completed to be bound around the binding terminal, the mixed material is filled into the space portion, so that the end of the wire being bound can be prevented from melting.

In still another invention, in addition to the above respective inventions, any one of the upper face of the upper flange portion or the lower face of the lower flange portion has a larger area than the other of the upper face of the upper flange portion or the lower face of the lower flange portion.

When it is structured as described above, each of the plurality of peripheral wall portions partially contacts the peripheral edge of any one of the upper flange portion and the lower flange portion having the upper face or the lower face of the larger area. At this time, between the drum core and the terminal member, the space is formed. Here, any of the outer peripheral edge of the other upper flange portion or the lower flange portion is in the state of having a gap between the space portion. Therefore, in the formation of the resin curing portion, when filling the uncured mixed material, the filling becomes easy.

Further, in still another invention, in addition to the above-described respective inventions, the resin curing portion is formed by curing the mixed material mixing the magnetic powders and the uncured resin.

When it is structured as described above, the inductance element can be formed simply by controlling the amount of the mixed material filled into the space portion and by curing the uncured mixed material thereafter. In other words, the steps to form the inductance element 10 can be simplified. In addition, the terminal members can serve as a container when filling the mixed material. Backed by this, the mixed material filled into the space portion can be prevented from leaking outside. Further, it is possible to prevent the mixed material from leaking outside, so that the work efficiency when filing the mixed material can be improved, in which variation in the amount of the mixed material to be filled (the amount of the resin curing portion after cured) can be prevented as well. Further, the variation in the amount of the resin curing portion can be prevented, so that the variation in the characteristics of the inductance element can be prevented.

Furthermore, with the mixed material, the drum core and the terminal member are firmly fixed (adhered). Therefore, even when the inductance element is mounted onto electric equipment such as a cellular phone, the shock resistance can be improved. Specifically, the mixed material filled into the space portion is that capable of serving also as an adhesive, so that the mixed material can joint the drum core and the terminal member firmly along with the boundary portion of the space portion. Backed by this, even when the inductance element suffers outside shock, the joint between the drum core and the terminal member can be maintained, so that the shock-resistance can be improved.

According to the present invention, downsizing and height reduction are allowed, in which reduction in parts and manufacturing steps are allowed as well.

DETAILED DESCRIPTION OF THE PREFERRED EMBODIMENTS

Figure 1:
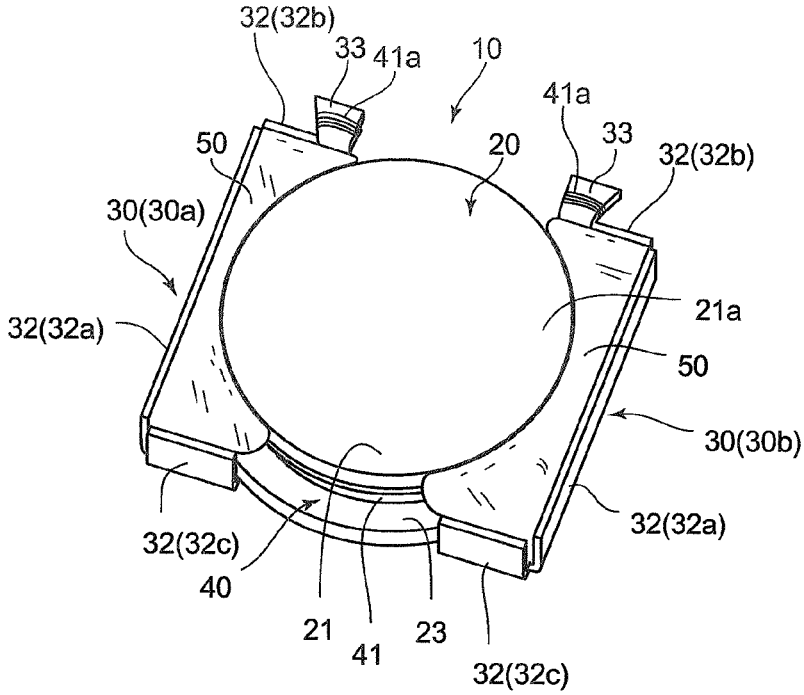
FIG. 1 is a perspective view viewing an inductance element according to an embodiment of the present invention from the upper side and showing the structure thereof.
Figure 2:
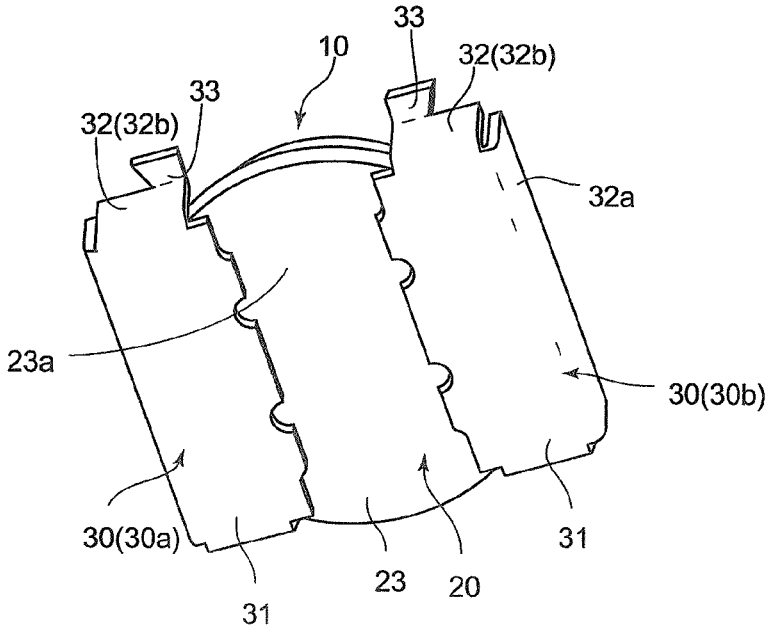
FIG. 2 is a perspective view viewing the inductance element in FIG. 1 from the lower side and showing the structure thereof.

Hereinafter, an embodiment of an inductance element according to one embodiment of the present invention will be described with reference to FIG. 1 to FIG. 6. FIG. 1 is a perspective view viewing an inductance element 10 from the upper side and showing the structure thereof, and FIG. 2 is a perspective view viewing an inductance element 10 from the lower side and showing the structure thereof. Also, FIG. 3 is a sectional side view showing the structure of the inductance element 10, in which a state of a plane passing through the center of a drum core 20 and cut in a perpendicular manner to a peripheral wall portion 32*a* is shown.

Note that, in the description below, the upper side means an upper flange portion 21 side when viewing from a lower flange portion 23, and the lower side means the lower flange portion 23 side when viewing from the upper flange portion 21.

As shown in FIG. 1, the inductance element 10 according to the present embodiment includes: the drum core 20, a cup body 30, a coil 40 and a resin curing portion 50. Of these, the drum core 20 includes: the upper flange portion 21, a columnar leg portion 22 and the lower flange portion 23.

Figure 3:
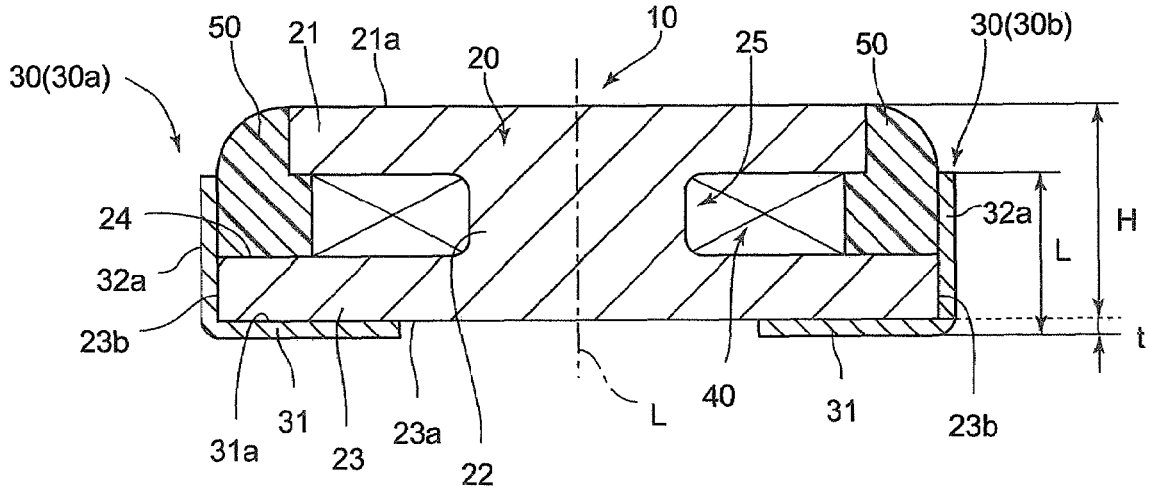
FIG. 3 is a sectional side view showing the structure of the inductance element in FIG. 1 in which a state of a plane passing through the center of the drum core and cut in a perpendicular manner to a longest peripheral wall portion is shown.

The drum core 20 is a disk-shaped drum body having a center axis L shown in FIG. 3, in which the upper flange portion 21, the columnar leg portion 22 and the lower flange portion 23 have a circular plane form. Further, the drum core 20 is made of a magnetic material such as a nickel ferrite core, as an example. However, the magnetic material is not limited to the nickel ferrite core and a manganese ferrite core is also acceptable. Similarly, the material of the drum core 20 is not limited to the ferrite core, and the other magnetic material such as Permalloy is also acceptable.

A lower face 23*a* of the lower flange portion 23 of the drum core 20 is formed to have a larger diameter as compared to an upper face 21*a* of the upper flange portion 21. Further, at an external diameter side of the lower flange portion 23, a mounting portion 24 to mount a later-described resin curing portion 50 thereon is provided (See FIG. 3).

Figure 5:
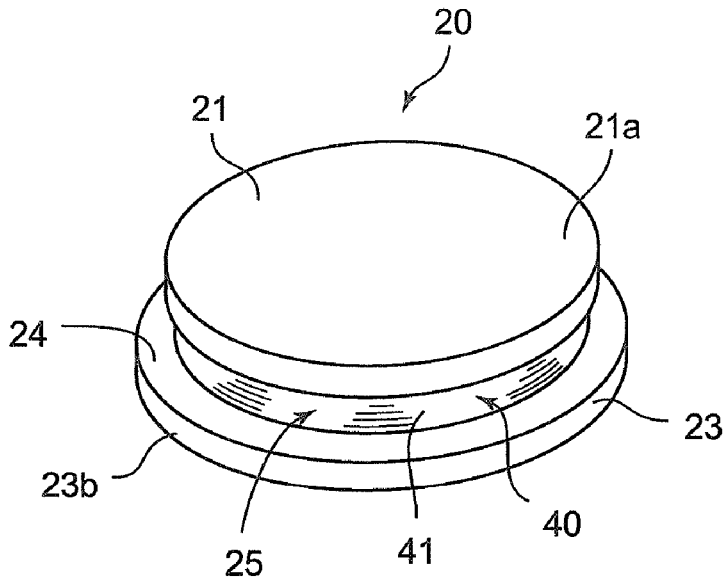
FIG. 5 shows a perspective view showing the state of the drum core of the inductance element in FIG. 1, in which a coil is arranged by winding a wire around the drum core.

Further, at the outer side portion of the columnar leg portion 22 and between the upper flange portion 21 and the lower flange portion 23, a winding frame portion 25 is provided. As shown in FIG. 5, a coil 40 is arranged at the winding frame portion 25. The coil 40 is formed by winding a wiring 41. Note that the wiring 41 is a wire rod of which outer peripheral portion is coated by an insulating coating film such as an enameled wire or the like. Further, the wiring 41 is a conductor of which section has virtually a circular form. However, the section of the wiring 41 is not limited to the virtual circular form, and a ribbon wire (straight angle wire) having a long rectangle section may be used as well.

Further, the insulating coating film made of the enamel or the like is removed from an end 41*a* of the wiring 41, which is to be bound around a later-described binding terminal 33. Based on this, the end 41*a* is in the state of electrically connected with the binding terminal 33. Note that, when the end 41*a* is soldered or the like to the binding terminal 33, the insulating coating film is melted due to heat to be removed therefrom, allowing favorable electrical conductivity between the end 41 a and the binding terminal 33.

Figure 6:
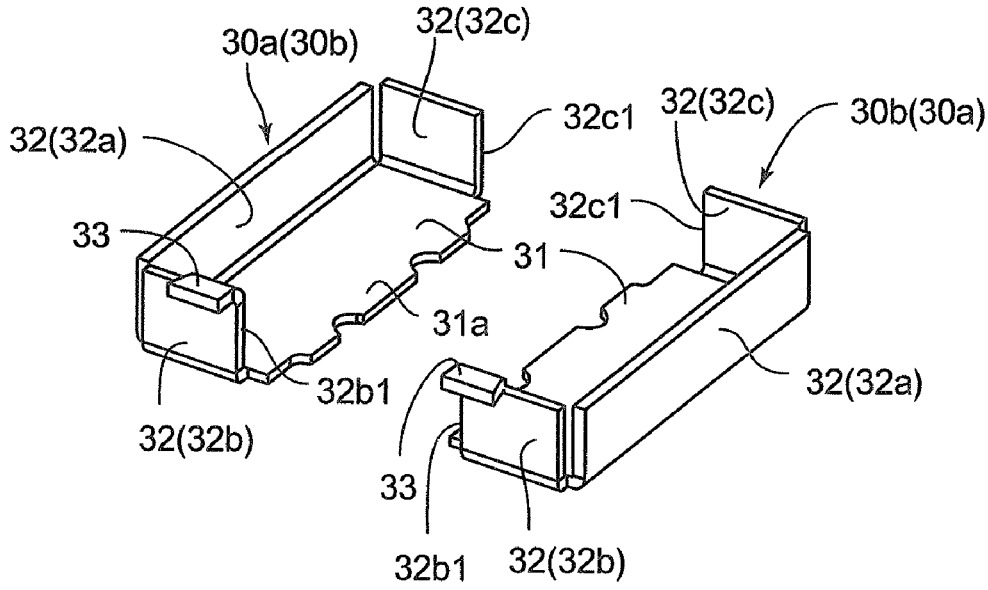
FIG. 6 is a perspective view showing a shape of a pair of cup terminals, out of the inductance element in FIG. 1.

Further, as shown in FIG. 2 and FIG. 6, the cup body 30 is a member composed of two cup terminals 30*a*, 30*b* made of metal. Each of the cup terminals 30*a*, 30*b* has a bottom portion 31, a peripheral wall portion 32 bent perpendicular to the bottom portion 31 and a biding terminal 33 to which the end 41*a* of a wiring 42 is bound. Of these, the bottom portion 31 is formed to have virtually a rectangular shape in the present embodiment. The bottom portion 31 is formed to have a long side of substantially the same size as of the diameter of the lower flange portion 23. Similarly, the short side of the bottom portion 31 is formed to be smaller than the radius of the lower flange portion 23. Based on this, when the cup terminals 30*a*, 30*b* are fitted into the drum core 20, they come to the state where a gap exists between the cup terminal 30*a* and the cup terminal 30*b*.

Note that the cup terminals 30*a*, 30*b* are preferably made of such a metal material that has a lower DC resistance out of the metal materials. Further, it is also desired that the material has strength against an expansive force arising when the later-described magnetic resin is cured. As a material satisfying the above-described conditions, phosphor bronze, copper, stainless or the like can be cited. However, the cup terminals 30*a*, 30*b* are not limited to those made of phosphor bronze, copper, stainless or the like, and any material can be adopted as long as the material has characteristics such as the strength and lower resistance.

Further, the peripheral wall portion 32 is formed so as to bend upward from the bottom portion 31. Therefore, the peripheral wall portion 32 is bent upward from the sides of the bottom portion 31 in appearance. There are provided three peripheral wall portions 32 in the present embodiment. Note, in the description below, when referring to three peripheral wall portions 32 separately) they are referred to as peripheral wall portions 32*a*, 32*b*, or 32*c* respectively.

Here, as shown in FIG. 3, the heights of the drum core 20 and the peripheral wall portion 32 are denoted respectively by "H" and "L", respectively. In the above-described cup terminals 30*a*, 30*b* (later-described space portion 35), the magnetic resin is filled as described later. Therefore, it is required that the magnetic resin filled therein is prevented from leaking from the cup terminals 30*a*, 30*b*, and at the same time, that a nozzle portion of a dispenser enters into the space portion 35 to favorably fill the magnetic resin thereinto. In order to satisfy both the above-described conditions, in the present embodiment, preferably, the upper edge portion of the peripheral wall portion 32 positions at a half height or above of the drum core 20. Further, preferably, the upper end portion of the peripheral wall portion 32 is provided not to exceed the upper face 21*a* of the drum core 20.

Specifically, even when the height L of the peripheral wall portion 32 increases, a space to fill the resin can be ensured when the height H the drum core 20 is increased, so that the resin can be filled easily. Meanwhile, the reduction in the height H of the drum core 20 leads to the reduction in the overall thickness of the inductance element 10, and, in that case, the definite space for filling the resin can be ensured by way of reducing the relative height L of the peripheral wall portion 32 (the space into which the nozzle portion of the dispenser enters can be ensured), being preferable. Based on this, it is possible to fill the resin stably, so that the characteristics of the inductance element 10 can be stabilized. Further, the inductance elements 10 can be mass-produced stably.

Here, the thickness of the bottom portion 31 is defined as "t", and what satisfying the above conditions can be expressed by an equation: $H/2 \leqq L-t<H$, and, it is preferable that the respective sizes are within this range. Note that, in the above-described range, the height H of the drum core 20 is assumed to be about 1.2 mm, however, the height H of the drum core 20 is not limited thereto, and the height H can be changed variously. Here, when the height H of the drum core 20 is lower than the assumed height, then the height L of the peripheral wall portion 32 is lowered. On the other hand, when the height H of the drum core 20 increases to over the assumed height) the height L of the peripheral wall portion 32 is increased.

Note that, when the magnetic resin is filled into the space portion 35, surface tension works to the magnetic resin filled. Therefore, even when the magnetic resin is filled into the space portion 35 to exceed the height of the upper end portion of the peripheral wall portion 32, the magnetic resin can be prevented from spilling outside backed by the effect of the surface tension.

As shown in FIG. 1 and FIG. 6 and the like, of the three peripheral wall portions 32*a* to 32*c*, the peripheral wall portion 32*a* is provided along with the long side of the bottom portion 31 and therefore the peripheral wall portion 32*a* is in the state of having the longest long side. Similarly, the peripheral wall portions 32*b*, 32*c* are provided along with the short side of the bottom portion 31. The peripheral wall portions 32*b*, 32*c* are distant from each other by sandwiching a cut therebetween, and therefore they are in the state of easily allowing a bending with respect to the bottom portion 31. Note that, in the present embodiment, the peripheral wall portions 32*b*, 32*c* are provided to have a size slightly shorter than the short side of the bottom portion 31 to the extent of the cut.

Further, as shown in FIG. 1, FIG. 2 and FIG. 6, the peripheral wall portions 32*b*, 32*c* have a binding terminal 33, respectively, to bind the end 41*a* of the wiring 41. The binding terminal 33 is a portion protruding from the upper end side of the peripheral wall portions 32*b*, 32*c*, respectively, toward the outer diameter side. This binding terminal 33 is formed by bending so that the binding terminals 33 bend from the peripheral wall portions 32*b*, 32*c* toward the outer diameter side.

Note that the peripheral wall portion 32*a* contacts an outer peripheral edge 23*b* of the lower flange portion 23 at the intermediate portion thereof. Further, the peripheral wall portions 32*b*, 32*c* contact the outer peripheral edge 23*b* of the lower flange portion 23 at the other edge portions 32*b*1, 32*c*1 (see FIG. 6) distant from the peripheral wall portion 32*a* (see FIG. 3 and FIG. 5). In addition, an upper side 31*a* of the bottom portion 31 contacts the lower face 23*a* of the lower flange portion 23. With these contacts, the cup terminals 30*a*, 30*b* is positioned with respect to the drum core 20.

Figure 4:
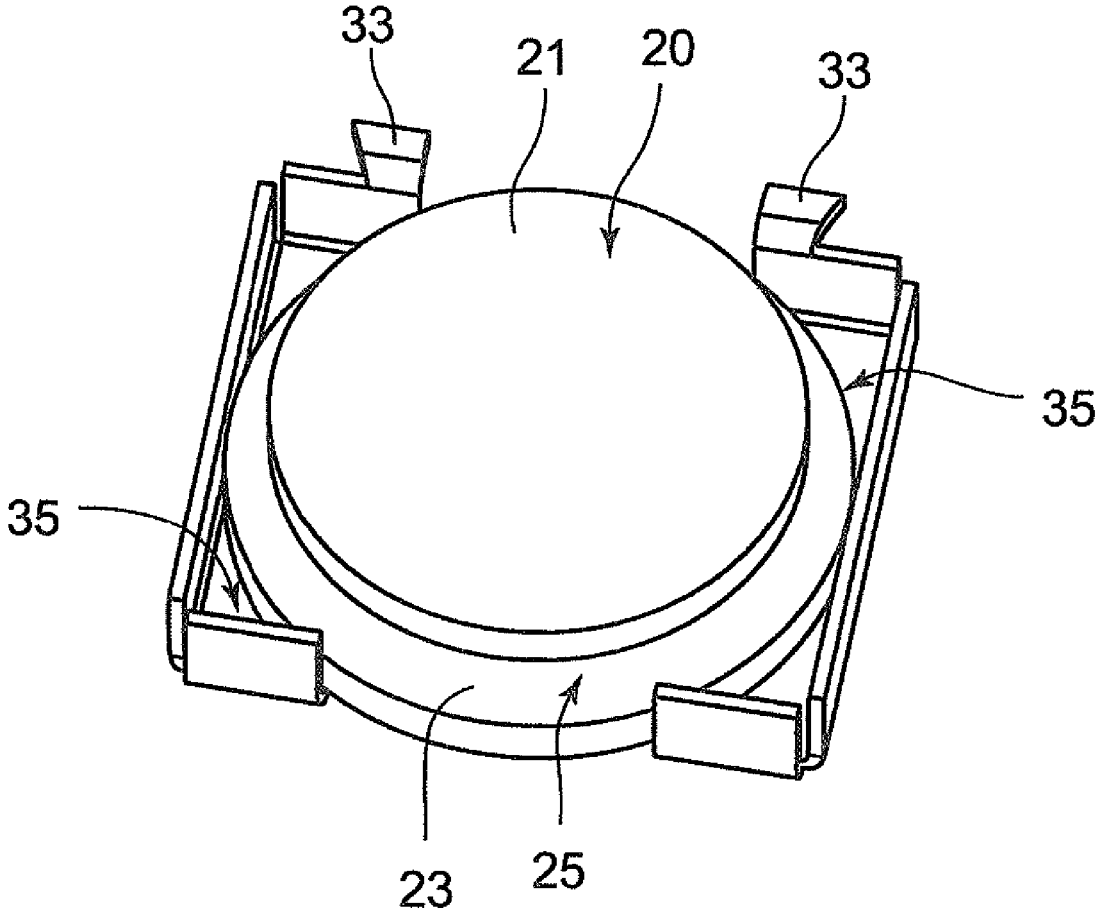
FIG. 4 is a perspective view showing the drum core and cup terminals composing the inductance element in FIG. 1 after the positioning between them is completed.

Further, as shown in FIG. 4, the space portion 35 is provided between the cup terminals 30*a*, 30*b* and the drum core 20. The space portion 35 is formed by the positioning between the drum core 20 and the cup terminals 30*a*, 30*b*. A magnetic resin as a mixed material is filled into the space portion 35.

Here, the magnetic resin is formed by mixing magnetic powders of a magnetic substance such as ferrite with an uncured resin material with fluidity such as an epoxy resin, and further by kneading the mixture. Note that the weight ratio of the magnetic powers to the magnetic resin is 60% to 95% though, 80% to 90% is preferable.

The magnetic resin as described above is filled into the space portion 35 via a later-described dispenser. Here, when the magnetic resin is filled into the space portion 35 and a thermal curing is performed thereafter, the filled magnetic resin is thermally cured. With this, the space portion 35 becomes a state of having the resin curing portion 50 arranged. Note that the resin material such as the epoxy resin or the like serves as an adhesive, so that, when the magnetic resin is cured to form the resin curing portion 50, the drum core 20 and the cup terminals 30*a*, 30*b* are adhered and are put into a fixed state. Further, the coil 40 arranged at the winding frame portion 25 is coated by the resin curing portion 50. Backed by this, the coil 40 is put into the state where it is fixed with respect to the drum core 20.

Hereinafter, the description will be given of a manufacturing method of the inductance element 10 having the structure as described above. First, the coil 40 is formed by winding the wiring 41 around the winding frame portion 25. At the same time, the cup terminals 30*a*, 30*b* are formed independently from the formation of the coil 40. When forming the cup terminals 30*a*, 30*b*, respectively, first, a not-shown metal plate member is punched out into predetermined shapes. At this time, the portions punched out from the metal plate member have the shape of the cup terminals 30*a* or 30*b*, respectively, in the form of an extend elevation.

Subsequently, the bending is performed with respect to each of the punched-out portion. With this, the cup terminals 30*a*, 30*b* each including the bottom portion 317 the peripheral wall portion 32 and the binding terminal 33 are formed from the punched-out portions. Here, in the present embodiment, the bending is performed with respect to the boundary portions between the bottom portion 31 and the peripheral wall portion 32 and between the peripheral wall portion 32 and the binding terminal 33, respectively. At this time, the three peripheral wall portions 32 are bent so that all the three are directed to the same direction. Note that, in the present embodiment, the bending is performed to form an angle of about 90 degrees.

Note that, the above-described punching and bending may be realized to be performed by a single press-forming operation.

Further, after the coil 40 is formed and the cup terminals 30*a*, 30*b* are formed, the positioning between the drum core 20 and the cup terminals 30*a*, 30*b* is performed. In this positioning, the lower face 23*a* of the lower flange portion 23 contacts the upper face 31 a of the bottom portion 31, while the intermediate portion of the peripheral wall portion 32*a* contacts the outer peripheral edge 23*b*. Further, the other end portions 32*b*1, 32*c*1 distant from the peripheral wall portion 32*a* contact the outer peripheral edge 23*b* as well.

Further, the end 41*a* of the wiring 41 is bound concurrently with the setting (positioning) of the above-described cup terminals 30*a*, 30*b*. In that case, by winding the end 41*a* with respect to binding terminal 33 plural number, the end 41a can be bound to the binding terminal 33. After that, the soldering is performed with respect to the binding terminal 33. Backed by this, the binding terminal 33 and the end 41*a* are firmly jointed, and, at the same time, the insulating coating film of the end 41*a* is melted by heat to be removed, so that the binding terminal 33 and the end 41*a* are put into the electrically-connected state.

Note that, as a soldering, a reflow soldering, a cream soldering and so forth can be performed, however, the binding terminal 33 and the end 41*a* may be jointed by the other method such as a silver-paste coating, a laser welding and so forth.

As described above, after the positioning between the drum core 20 and the cup terminals 30*a*, 30*b* is performed and the end 41*a* is bound to the binding terminal 33, the magnetic resin is filled into the space portion 35. When filling the magnetic resin into the space portion 35, for example a predetermined amount of the magnetic resin is supplied to respective plural portions along the long side of the peripheral wall portion 32*a* intermittently. At this time, the magnetic resin is supplied using the not-shown dispenser using the effect of air pressure of compressed air. Further, the amount of the magnetic resin to be supplied is that the magnetic resin exceeds the upper end portion of the peripheral wall portion 32 and does not exceed the upper face 21*a*. Even supplied in this manner, the supplied magnetic resin can be prevented from leaking outside on the back of the effect of the surface tension with respect to the magnetic resin.

Note that the magnetic resin is formed in advance by mixing the resin material with the magnetic powders, before the filling into the space portion 35.

After the magnetic resin is filled into the space portion 35, continuously, the magnetic resin is cured. When the magnetic resin is cured, for example, thermal curing is performed using a not-shown curing apparatus. At this time, the unfinished body of the inductance element 10 is set inside a curing oven in the curing apparatus. Then, it is heated inside the curing oven for a predetermined time at a predetermined degree of temperature, in which the thermal curing is performed with respect to the uncured magnetic resin, so that the resin curing portion 50 is formed.

Note that an additional processing such as a cutting and so forth may be performed as appropriate with respect to the resin curing portion 50 after completing the thermal curing. As described above, the inductance element 10 is manufactured, and further, the manufactured inductance element 10 is mountable onto a predetermined portion of a mounting substrate, and when such a mounting is performed, the bottom portion 31 and the mounting substrate may be jointed such as by soldering.

According to the inductance element 10 thus structured, the winding frame portion 25 and the coil 40 are put into the state where they are coated by the resin curing portion 50. Here, the resin curing portion 50 is formed by thermal curing of the magnetic resin containing the resin material and the magnetic powders. Of the magnetic resin as described above, the resin material serves as an adhesive while the magnetic powders serve as a magnetic member Therefore, the outer peripheral side of the winding frame portion 25 and the coil 40 is put in the state where the magnetic member is arranged, allowing the resin curing portion 50 to serve alternatively as the ring-type core, which is used in the current (conventional) inductance element. Therefore, the ring-type core is not required, so that the number of parts can be reduced. Further, the reduced number of parts allows the cost reduction.

Further, the lower face 23*a* of the lower flange portion 23 has a larger area than that of the upper face 21*a* of the peripheral wall portion 21. In addition, the cup terminals 30*a*, 30*b* includes a bottom portion 31 of a rectangular plane shape together with the three peripheral wall portions 32. And that, the peripheral wall portion 32*a* contacts the outer peripheral edge 23*b* at the intermediate portion thereof while the peripheral wall portions 32*b*, 32*c* contact the outer peripheral edge 23*b* at the other edge portions 32*b*1, 32*c*1 distant from the peripheral wall portion 32*a*. Accordingly, the positioning between the drum core 20 and the cup terminals 30*a*, 30*b* can be performed surely, Further, when the positioning is performed, the space portion 35 is formed, so that the capacity of the space portion 35 is then determined. Subsequently, the amount of the magnetic resin to be filled into the space portion 35 is determined. Accordingly, the amount of the magnetic resin to be filled into the space portion 35 can be controlled, and simply by curing the magnetic resin thereafter, the inductance element 10 can be formed. In other words, the steps to form the inductance element 10 can be simplified.

Further, the cup terminals 30*a*, 30*b* according to the present embodiment can serve as a container when filling the magnetic resin. With this, the magnetic resin filled into the space portion 35 is prevented from leaking outside from the space portion 35. Further, the magnetic resin can be prevented from leaking outside, so that an additional work caused by the outward leak of the magnetic resin can be prevented from arising. Based on that, the work efficiency when filling the magnetic resin can be improved, and the variation in the amount of the magnetic resin filled (the amount of the resin curing portion 50 after it is cured) can be suppressed Further, it is possible to suppress the variation in the amount of the magnetic resin filled (the amount of the resin curing portion 50 after it is cured), so that the variation in the characteristics of the inductance element 10 can be suppressed.

Further, the binding terminal 33 is provided to the peripheral wall portion 32*b* or the peripheral wall portion 32*c*. Therefore, when the end 41*a* is bound to the binding terminal 33 after the insulating coating film such as enamel is removed, the electrical connection between the cup terminals 30*a*, 30*b* and the wiring 41 can be conducted favorably. Further, the end 41*a* is bound to the binding terminal 33, so that the end 41*a* that is bound can be prevented from unfastening, when the magnetic resin supplied into the space portion 35 is cured.

Further, in the present embodiment, the outer peripheral edge 23*b* contacts the peripheral wall portion 32*a* directly and also contacts the other edge portions 32*b*1, 32*c*1 of the peripheral wall portions 32*b*, 32*c* directly as well. Therefore, when comparing with such a type of a conventional inductor, out of the conventional inductance elements, that has the outer peripheral portion following an arc, for the bottom face of the cup terminal, and that is to have the ring core fitted thereinto, the inductance element can be downsized further.

Specifically, when the cup terminal having the outer peripheral portion following the arc is used, the outer peripheral side of the inductance element increases in size equally, as in the conventional inductance element. However, in the inductance element 10 according to the present embodiment, the bottom portion 31 of the cup terminals 30*a*, 30*b* has substantially a rectangular shape, in which the size of the outer peripheral side of the inductance element 10 does not increase equally, but increase partially. Therefore, the mounting area of the inductance element 10 is not increased so much, so that the inductance element 10 can be downsized.

Further, the inductance element 10 according to the present embodiment has the structure, in which the drum core 20 and the cup terminals 30*a*, 30*b* are firmly cured (adhered) by resin material. Therefore, even when the inductance element 10 is mounted onto electric equipment such as a cellular phone, the shock resistance can be improved. Specifically, since the magnetic resin serving also as the adhesive is filled into the space portion 35, the magnetic resin can firmly joint the drum core 20 and the cup terminals 30*a*, 30*b* while following the boundary portion of the space portion 35. Backed by this, even when the inductance element 10 suffers an outside shock, the joint between the drum core 20 and the cup terminals 30*a*, 30*b* can be held, so that the shock resistance can be improved.

As has been described above, although one embodiment of the inductance element 10 according to the present invention has been described, the present invention can be modified variously in addition to the above. Hereinafter, the description will be given of the other modification.

Figure 7:
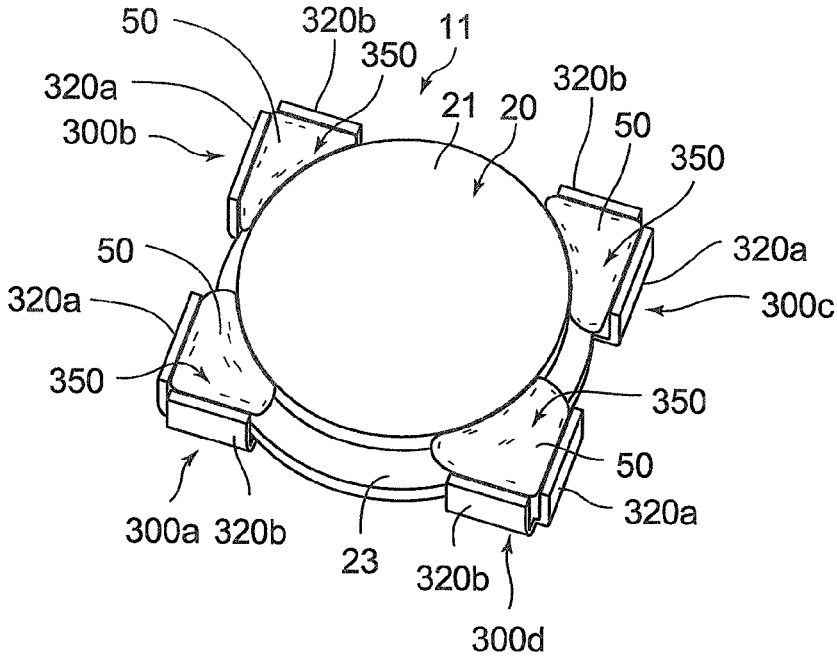
FIG. 7 is a perspective view when viewing from an upper side, showing a structure related to a modification example of the inductance element of the present invention and having four cup terminal.
Figure 8:
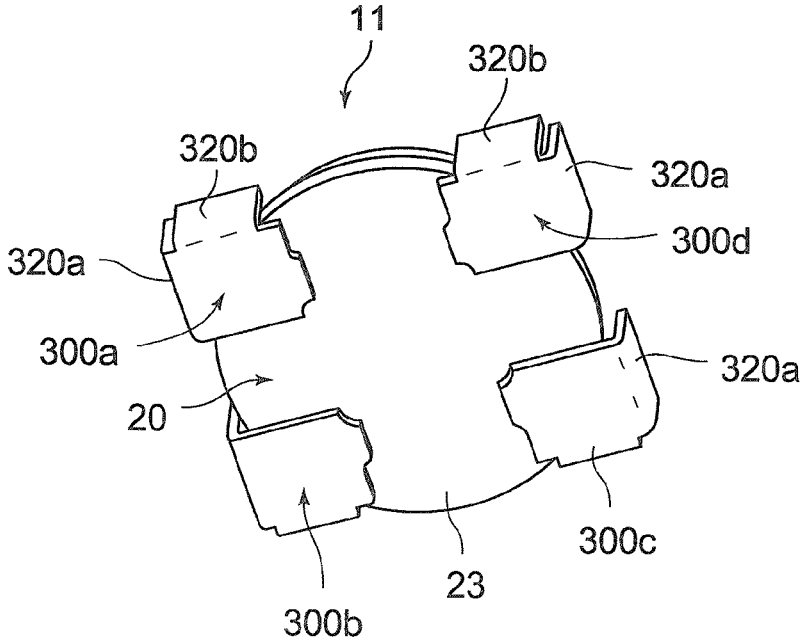
FIG. 8 is a perspective view viewing the inductance element in FIG. 7 from the lower side and showing the structure thereof.

In the above-described embodiment, the structure in which two pieces of the cup terminal 30*a*, 30*b* are used as terminal members is described. However, the number of the terminal members to be used is not limited to two and more than two is also acceptable. One example thereof is shown in FIG. 7 and FIG. 8. In FIG. 7 and FIG. 8, an inductance element 11 having four cup terminals 300*a*, 300*b*, 300*c*, 300*d* are disclosed.

Here, each of the cup terminals 300*a* to 300*d* has a structure having two peripheral wall portions 320*a*, 320*b*, differently from the structure having the three peripheral wall portions 32*a* to 32*c* shown in FIG. 1 and the like. However, even the cup terminals 300*a* to 300*d* each having only two peripheral wall portions 320*a*, 320*b* contact the cup body 30 at three points, respectively, so that the positioning with respect to the drum core 20 can be performed favorably.

In the inductance element 11 shown in FIG. 7 and FIG. 8, spaces 350 have a smaller area as compared to the inductance element 10 in FIG. 1 and the like. Therefore, the amount of the magnetic resin to be filled can be reduced further. Note that, the structure shown in FIG. 7 and FIG. 8 can be used, for example, as a transformer or the like in addition to a filter, a choke coil and the like. Note that, as can be know by the fact that the inductance element having the structure can be used as the transformer or the like, the concept of the inductance element includes the transformer.

Further, in the above-described embodiment, the cup terminals 30*a*, 30*b* of the bottom face having a rectangular shape when viewing form the lower side is used. However, the shape of the bottom face of the cup terminal is not limited to the rectangle, and various polygonal shapes including triangle, hexagon can be used. Further, the shape other than the polygonal shape, for example, oval can also be used for the bottom shape of the cup terminal.

Further, in the above-described embodiment, the cup terminals 30*a*, 30*b* has the binding terminal 33, respectively. However, the binding terminal 33 is not necessary be required, and the structure without the binding terminal 33 can also be adopted In the case where the binding terminal 33 is not provided, the end 41*a* is put into the state directly jointed to the cup terminals 30*a*, 30*b* by soldering or the like. Further, the binding terminal 33 is not limited to the shape shown in FIG. 1 or the like, and various shapes are acceptable.

The inductance element according to the present invention can be used in the field of electric equipment.

What is claimed is:

1. An inductance element comprising:

a drum core including an upper flange portion, a lower flange portion and a columnar leg portion coupling the upper flange portion and the lower flange portion together with a wiring frame portion surrounded by the upper flange portion, the lower flange portion and the columnar leg portion;

a coil arranged at the wiring frame portion and formed by winding a wire; and a resin curing portion formed by curing a mixed material mixing magnetic powders and uncured resin and coating at least the wiring frame portion and said coil; and a plurality of terminal members each including a bottom portion formed to have a polygonal shape and a plurality of peripheral wall portions provided upright from any side of the bottom portion, the respective plurality of peripheral wall portions contacting partially with outer peripheral edge of the lower flange portion such that the portion of the peripheral edge of the lower flange that is in contact with the walls is smaller than the portion of the peripheral edge that does not contact the walls, wherein a space portion is formed between the peripheral wall portion and said drum core to form said resin curing portion by being filled with the mixed material thereinto.

2. The inductance element according to claim 1, wherein any of the plurality of peripheral wall portions is provided with a binding terminal to bind an end of the wiring.

3. The inductance element according to claim 1, wherein any one of an upper face of the upper flange portion and a lower face of the lower flange portion has a larger area than another face of the upper face of the upper flange portion and the lower face of the lower flange portion.

4. The inductance element according to claim 2, wherein any one of an upper face of the upper flange portion and a lower face of the lower flange portion has a larger area than another face of the upper face of the upper flange portion and the lower face of the lower flange portion.

5. The inductance element according to claim 1, wherein said resin curing portion is formed by curing a mixed material mixing the magnetic powders and the uncured resin.

6. The inductance element according to claim 2, wherein said resin curing portion is formed by curing a mixed material mixing the magnetic powders and the uncured resin.

7. The inductance element according to claim 3, wherein said resin curing portion is formed by curing a mixed material mixing the magnetic powders and the uncured resin.

* * * * *